US006739529B2

(12) United States Patent
Linger et al.

(10) Patent No.: US 6,739,529 B2
(45) **Date of Patent: *May 25, 2004**

(54) NON-METALLIC PARTICLE BLASTING NOZZLE WITH STATIC FIELD DISSIPATION

(75) Inventors: David Linger, Loveland, OH (US); Mike Rivir, Norwood, OH (US); Ross Leon, Cincinnati, OH (US)

(73) Assignee: Cold Jet, Inc., Loveland, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/369,797

(22) Filed: Aug. 6, 1999

(65) Prior Publication Data

US 2001/0040195 A1 Nov. 15, 2001

(51) Int. Cl.[7] ..... A62C 31/02; B05B 1/00; B05B 5/00

(52) U.S. Cl. ..... 239/589; 239/602; 239/691; 239/390

(58) Field of Search ..... 239/589, 602, 239/691, DIG. 19, DIG. 21, 1, 390, 690, 690.1, 706, 707; 138/127, 104, DIG. 19; 222/402.13, 402.1, 402.3

(56) References Cited

U.S. PATENT DOCUMENTS

| | | | | | |
|---|---|---|---|---|---|
| 3,009,441 | A | * | 11/1961 | Juvinall | 239/591 |
| 3,982,157 | A | * | 9/1976 | Azuma et al. | 317/2 |
| 4,241,878 | A | * | 12/1980 | Underwood | 138/127 |
| 4,347,984 | A | * | 9/1982 | Sickles | 239/690.1 |
| 4,611,762 | A | * | 9/1986 | Turner et al. | 239/708 |
| 4,675,780 | A | * | 6/1987 | Barnes et al. | 138/127 |
| 4,744,181 | A | * | 5/1988 | Moore et al. | 51/436 |
| 4,843,770 | A | * | 7/1989 | Crane et al. | 51/439 |
| 4,870,535 | A | * | 9/1989 | Matsumoto | 138/127 |
| 5,050,805 | A | * | 9/1991 | Lloyd et al. | 239/424 |
| 5,109,636 | A | * | 5/1992 | Lloyd et al. | 51/320 |
| 5,188,151 | A | * | 2/1993 | Young et al. | 137/874 |
| 5,301,509 | A | * | 4/1994 | Lloyd et al. | 62/35 |
| 5,473,903 | A | * | 12/1995 | Lloyd et al. | 62/35 |
| 5,477,993 | A | * | 12/1995 | Maeda | 222/402.1 |
| 5,571,335 | A | * | 11/1996 | Lloyd | 134/1 |
| 5,660,580 | A | * | 8/1997 | Lehnig | 451/38 |
| 5,795,214 | A | * | 8/1998 | Leon | 451/102 |
| 6,105,886 | A | * | 8/2000 | Hollstein et al. | 239/700 |
| 6,276,618 | B1 | * | 8/2001 | Yanagida et al. | 239/693 |

* cited by examiner

*Primary Examiner*—Davis Hwu
(74) *Attorney, Agent, or Firm*—Frost Brown Todd LLC

(57) ABSTRACT

A blast nozzle formed of a non-conductive material includes electrically conductive paths embedded therein to keep the build up of static electricity below an undesirable level. Stainless steel rods extend the length of the blast nozzle, providing a continuous electrical path.

23 Claims, 4 Drawing Sheets

NON-METALLIC PARTICLE BLASTING NOZZLE WITH STATIC FIELD DISSIPATION

TECHNICAL FIELD

The present invention relates generally to nozzles for the discharge of entrained particle flow, and is particularly directed to a particle blasting nozzle which dissipates static field build-up around the nozzle. The invention will be specifically disclosed in connection with a nozzle constructed from a non-conductive material and configured for discharging entrained carbon dioxide particles.

BACKGROUND OF THE INVENTION

Nozzles for discharging entrained particle flow are well known. Particle blasting machines include such nozzles which are sometimes referred to as blast nozzles or blasting nozzles. A blast nozzle is used to direct a flow of entrained particles toward a target. Depending upon the type of system, the nozzle may be configured for subsonic or supersonic flow. The system may use a two-hose delivery system, which is typically low velocity, or a single hose delivery system, which is typically high velocity.

Blast nozzles are typically constructed from a variety of materials, such as metal, ceramic or plastic. Polymer blast nozzles have numerous advantages over metallic nozzles. Polymer nozzles are lighter than metallic blast nozzles, an important factor for operator satisfaction and overall system ergonomics. Polymer blast nozzles are softer than metallic nozzles and are less likely to damage the target workpiece in the event that there is contact between the two. Aesthetically, the appearance of polymer nozzles is affected less by surface damage, such as nicks, scratches and dents, than with metallic nozzles.

However, under certain conditions, the movement of entrained particles through a blast nozzle made from a non-conductive material, such as polymer, creates a static electricity field around the nozzle that cannot dissipate through the nozzle. The static field can build up to a level at which arcing occurs. Arcing to the workpiece is generally not a problem since the workpiece is typically grounded. Arcing from the nozzle to the operator is a problem as it can cause the operator to feel a painful shock. Arcing from one part of the nozzle to another is also a problem as it can cause the operator to feel a tingle if the arc is strong/long enough.

The primary factor in the generation of static electricity is the velocity of the particles traveling through a non-conductive passageway. The particle velocity of a two hose carbon dioxide particle blast system is typically about 400 feet per second and does not result in significant static field build up. The particle velocity of a single hose carbon dioxide blast system is typically about 800 feet per second and results in significant static field build up. Other factors affecting static electricity build up include ambient humidity and temperature, flow stream humidity and temperature and the type of blast media.

Thus, there is a need in the art for a non-conductive blast nozzle which will dissipate static electricity preventing it from building up to undesirable levels.

SUMMARY OF THE INVENTION

It is an object of this invention to obviate the above-described problems and shortcomings of the prior art heretofore available.

It is another object of the present invention to provide a blast nozzle constructed from a non-conductive material which dissipates static electricity.

It is yet another object of the present invention to provide a blast nozzle constructed from a non-conductive material which prevents the build up of static electricity to an undesirable level.

It is another object of the present invention to provide a blast nozzle constructed from a a non-conductive material which reduces or eliminates shock to the operator from static electricity.

It is still a further object of the present invention to provide a blast nozzle constructed from a non-conductive material which eliminates or reduces to a desirable level electrical arcing across the nozzle.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, there is provided a blast nozzle, constructed from a non-conductive material, which incorporates a plurality of electrically conductive paths.

In accordance with another aspect of the present invention, the electrically conductive paths are continuous.

In yet a further aspect of the present invention, the electrically conductive paths are formed of stainless steel rods embedded within the nozzle.

In another aspect of the present invention, the nozzle material includes anti-static additives.

BRIEF DESCRIPTION OF THE DRAWINGS

The accompanying drawings incorporated in and forming a part of the specification illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
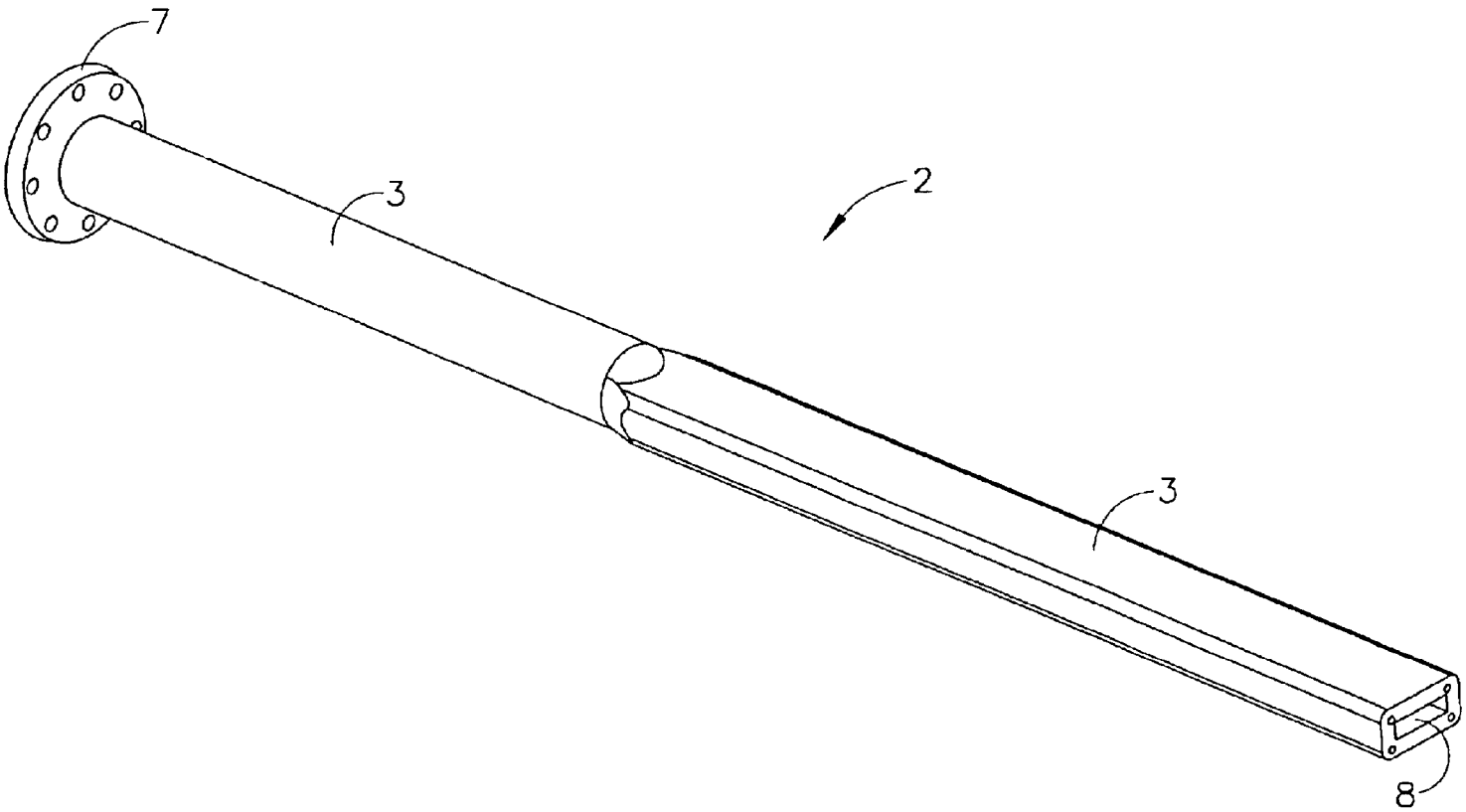
FIG. 1 is a perspective view of a blast nozzle constructed in accordance with the teachings of the present invention.

Referring now to the drawings in detail, wherein like numerals indicate the same elements throughout the views, FIG. 1 is a perspective view of a blast nozzle 2 constructed in accordance with the teachings of the present invention. Blast nozzle 2 is configured for use with carbon dioxide blasting. Carbon dioxide blasting systems are well known in the industry, and along with various associated component parts, are shown in U.S. Pat. Nos. 4,744,181, 4,843,770, 4,947,592, 5,050,805, 5,018,667, 5,109,636, 5,188,151, 5,301,509, 5,571,335, 5,301,509, 5,473,903, 5,660,580 and 5,795,214, all of which are incorporated herein by reference. Although the present invention will be described herein in connection with a blast nozzle configured for use with carbon dioxide blasting, it will be understood that the present invention is not limited in use or application to blast nozzles or carbon dioxide blasting. The teachings of the present invention may be used in application in which there can be a build up of static electricity due to flow.

Figure 2:
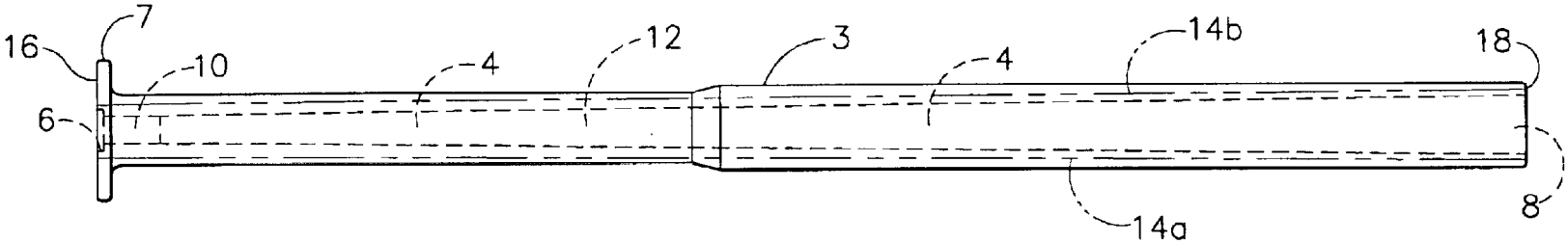
FIG. 2 is a plan view of the nozzle shown in FIG. 1.
Figure 3:
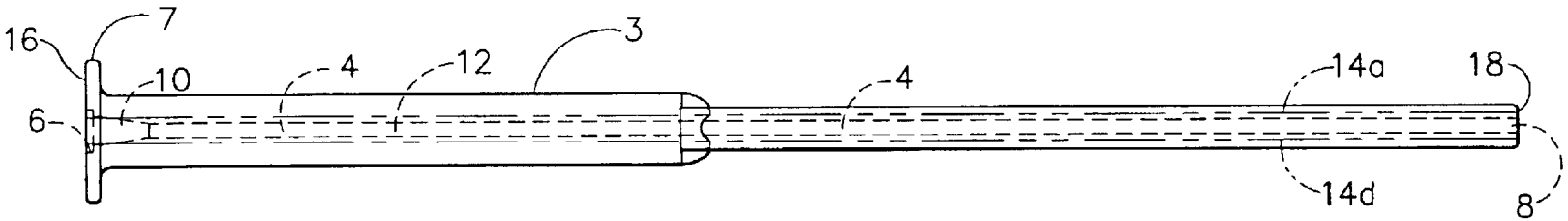
FIG. 3 is a side view of the nozzle shown in FIG. 1.

Referring to FIGS. 2 and 3, blasting nozzle 2 includes body 3 which defines an internal flow passageway 4 which has entry 6 and exit 8. Flange 7 is used to mount nozzle 2 to the nozzle gun. Although passageway 4 is configured to produce supersonic flow, having converging section 10 and diverging section 12, it will be understood that application of the present invention is not necessarily limited to supersonic flow. Nozzle 2 is made primarily of a non-conductive material, such as any polymer, with anti-static (electrically conductive) additives, such as carbon black. The amount of anti-static material that can be incorporated with the non-conductive material is limited by the need to maintain the structural integrity of the nozzle. In one embodiment, the nozzle is constructed from a proprietary material available to the assignee of the present invention from Parkway Products, Inc. located at 10293 Burlington Road, Cincinnati, Ohio, designated as PKY 330, which is 70 durometer blend of Adiprine (Adiprine is a trademark of Uniroyal) urethane with 0.25 grams per hundred of an anti-static additive sold under the name Catafordu from Aceto. As used herein, non-conductive material refers to any material which, when used to define a flow passageway, permits the build up of static electricity to a level at which arcing occurs.

While the use of anti-static additives is helpful in reducing the build-up of static electricity, the formulations presently available are not sufficient alone. Therefore, nozzle 2 includes electrically conductive material imbedded within nozzle 2 to form electrically conductive paths within nozzle 2. These paths are preferably grounded, dissipating any electrical field before it builds up to an undesirable level.

Figure 4:
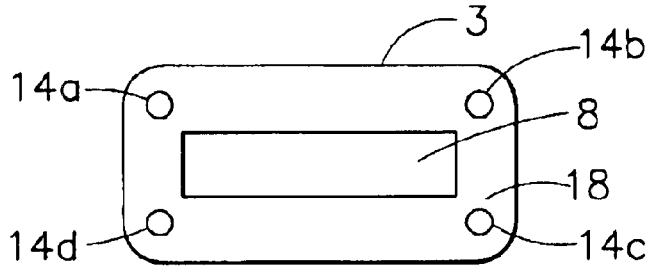
FIG. 4 is end view of the exit end of the nozzle shown in FIG. 1.
Figure 5:
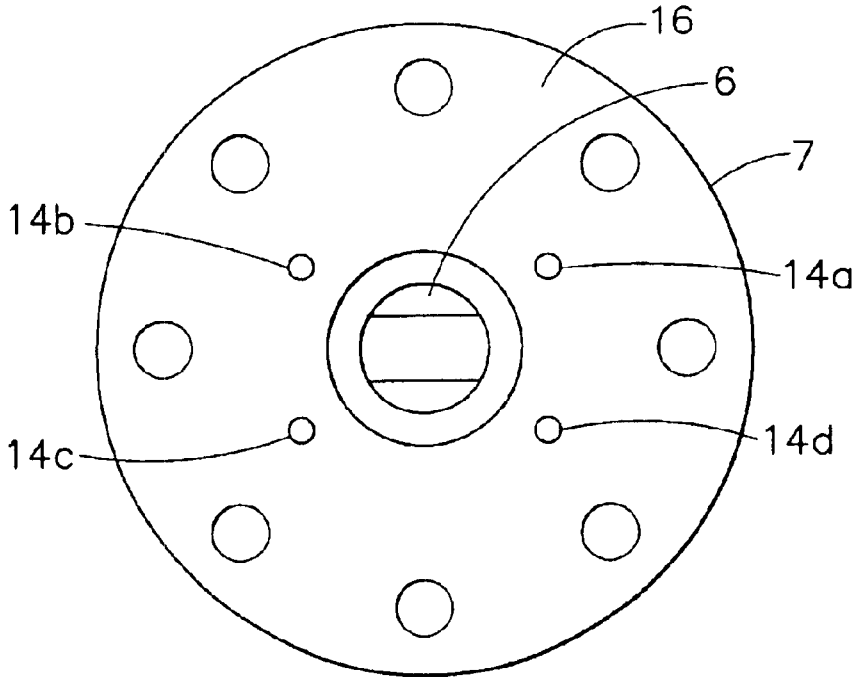
FIG. 5 is an end view of the entry end of the nozzle shown in FIG. 1.

In the illustrated embodiment, the electrically conductive paths comprise four rods 14*a*–14*d* imbedded in nozzle 2 extending from entry end 16 of nozzle 2 to exit end 18 of nozzle 2. Rods 14*a*–14*d* do not extend into passageway 4, which would affect the aerodynamics and flow characteristics of nozzle 2. Referring to FIGS. 4 and 5, the locations of the ends of rods 14*a*–14*d* are illustrated.

In one embodiment, rods 14*a*–14*d* extend to and slightly beyond the respective surfaces forming entry end 16 and exit end 18. The extension at entry end 16 allows rods 14*a*–14*d* to be grounded. Such grounding may be accomplished simply by the mating of nozzle 2 to the nozzle gun (not shown), which is itself grounded, placing the ends of rods 14*a*–14*d* either in direct contact, or at least in close enough proximity, with the grounded gun. Grounding of rods 14*a*–14*d* may be accomplished by any other grounding method, including for example, directly connecting a grounding wire to rods 14*a*–14*d*. Rods 14*a*–14*d* may be grounded by connections at other points along their length. It is noted that in carbon dioxide blasting systems, it is known to wrap the delivery hose with an anti-static material, such as a cotton sleeve with imbedded metal filings or "static string" such as depicted in U.S. Pat. Nos. 5,690,014 and 5,740,006.

In the depicted embodiment, rods 14*a*–14*d* are made from stainless steel, although any electrically conductive material may be used. Rods 14*a*–14*d* also provide some structural integrity to nozzle 2. When nozzle 2 is constructed from urethane, it returns to its original shape if bent. Rods 14*a*–14*d* slide within nozzle 2 and can hold a slight bend, allowing he nozzle to be intentionally bent slightly.

Figure 6:
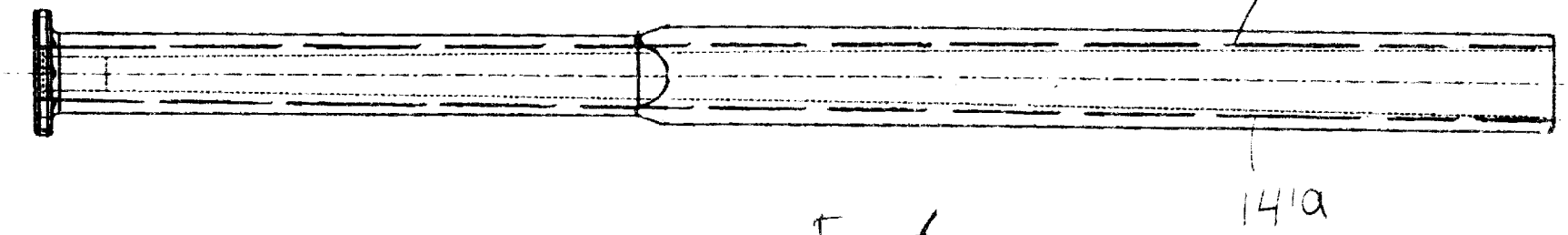
FIG. 6 is a plan view of another embodiment of the present invention illustrating non-continuous conductive paths.
Figure 7:
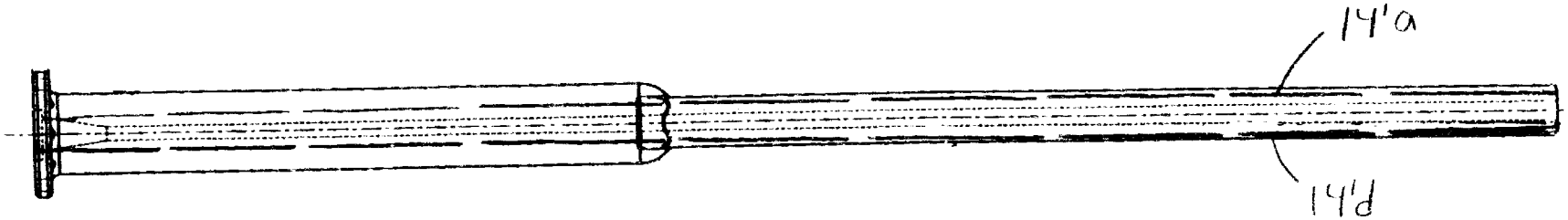
FIG. 7 is a side view of the nozzle of FIG. 6.

Rods 14*a*–14*d* provide continuous electrically conductive paths which prevent the build up of a static electricity filed along the length of nozzle 2. Transverse arcing across the width of the nozzle is reduced to half of the distance between electrically conductive paths. Empirically, arcing of less than half an inch does not give the operator a tingle. While there is no exact arc length to be avoided, applicants believe that keeping arcing below ¾ inch will keep static field build up below an undesirable level. Non-continuous electrically conductive paths, as illustrated at 14'*a*–14'*d* in FIGS. 6 and 7, may also be used to provide dissipation of static electricity sufficient to keep the build up below an undesirable level. Additionally, although rods 14*a*–14*d* are depicted as extending the entire length of nozzle 2, the electrically conductive paths do not have to extend the entire length. The electrically conductive paths may, for example, stop short of exit end 18.

Although four rods 14*a*–14*d* are illustrated disposed in a generally rectangular arrangement, the number and location of electrically conductive paths depends upon the nozzle size, shape and material, as well on the nature and flow characteristics of the media for which the nozzle is used. For example, if nozzle 2 were constructed of a non-conductive material without anti-static additives, additional electrically conductive paths would be necessary to prevent undesirable levels of static electricity. A nozzle wider than the 3 inch wide nozzle depicted in the figures may require additional electrically conductive paths. Depending on such application characteristics, a single electrically conductive path may be sufficient.

In order to ensure that rods 14*a*–14*d* do not extend into passageway 4, each respective rod 14*a*–14*d* is gripped at each end and kept under tension to prevent sagging while the nozzle material is introduced into the mold cavity. Once solidified, the nozzle is removed from the cavity and the rods 14*a*–14*d* are ground down to be nearly flush with the ends of the nozzle.

Although rods 14*a*–14*d* are depicted as straight, various shapes suitable for the nozzle geometry may be used. The electrically conductive paths may follow a circuitous path, such as wrapping in a spiral fashion along the nozzle. The electrically conductive paths could be formed of a mesh material. If the requisite structural integrity can be maintained, a wire mesh sleeve could completely or partially surround the passageway.

The electrically conductive paths can be disposed within nozzle 2 in any appropriate location, preferably internal to nozzle 2. The disposition of rods 14*a*–14*d* on the outside of nozzle 2, or at exposed locations creates wear potential which are preferably avoided.

In accordance with this invention, electrically conductive paths may be advantageously used with any passageway in which prevention or reduction of a static is desirable.

In summary, numerous benefits have been described which result form employing the concepts of the invention. The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A blast nozzle configured to have a flow of entrained particles flow therethrough, said flow following a downstream flow path upon exiting said blast nozzle, said blast nozzle comprising:

a. a body constructed of a non-conductive material, said body defining an internal flow passageway, said body having an entry end and an exit end, said internal passageway having an entry at said entry end and an exit at said exit end; and b. a plurality of electrically conductive paths disposed at least partially in said body, said electrically conductive paths not extending into said internal flow passageway, said electrically conductive paths not extending to said downstream flow path.

2. The blast nozzle of claim 1, wherein said plurality of electrically conductive paths comprises mesh material.

3. The blast nozzle of claim 2, wherein said mesh material comprises a sleeve disposed outside of said internal passageway.

4. The blast nozzle of claim 3, wherein said sleeve extends from proximal said entry end to proximal said exit end.

5. The blast nozzle of claim 3, wherein between said entry end and said exit end, said sleeve is disposed completely within said body.

6. The blast nozzle of claim 3, wherein a portion of said sleeve extends beyond at least one of said entry end and said exit end.

7. The blast nozzle of claim 2, wherein said mesh material comprises a plurality of discrete mesh segments.

8. The blast nozzle of claim 7, wherein at least one of said discrete mesh segments extends from proximal said entry end to proximal said exit end.

9. The blast nozzle of claim 1, wherein each of said plurality of electrically conductive paths comprises respective discrete paths.

10. The blast nozzle of claim 9, wherein said respective discrete paths comprise spaced apart rods.

11. The blast nozzle of claim 10, wherein at least one of said spaced apart rods extends from proximal said entry end to proximal said exit end.

12. The blast nozzle of claim 9, wherein said respective discrete paths each comprise mesh material.

13. The blast nozzle of claim 1, wherein at least one of said plurality of electrically conductive paths extends substantially continuously from proximal said entry end to proximal said exit end.

14. The blast nozzle of claim 13, wherein a portion of said at least one of said plurality of electrically paths extends beyond at least one of said entry end and said exit end.

15. The blast nozzle of claim 1, wherein, between said entry end and said exit end, said plurality of electrically conductive paths are disposed completely within said body.

16. The blast nozzle of claim 15, wherein all of said plurality of electrically conductive paths are disposed outside of said internal passageway.

17. The blast nozzle of claim 1, wherein said plurality of electrically conductive paths are non-continuous between proximal said entry end and proximal said exit end.

18. The blast nozzle of claim 1, wherein said plurality of electrically conductive paths are located spaced apart from each other a distance such that any electrical arcing that may occur is maintained below a predetermined length.

19. The blast nozzle of claim 18, wherein said predetermined length is less than about ¾ inch.

20. A blast nozzle comprising:

a. a body constructed of a non-conductive material, said body defining an internal flow passageway, said body having an entry end and an exit end, said internal flow passageway having an entry at said entry end and an exit at said exit end; and b. a plurality of electrically conductive paths disposed between said entry end and said exit end, adjacent and outside of said body.

21. A blast nozzle comprising:

a. a body constructed of a non-conductive material, said body defining an internal flow passageway, said body having an entry end and an exit end, said internal flow passageway having an entry at said entry end and an exit at said exit end; and b. at least one electrically conductive rod disposed, between said entry end and said exit end, completely within said body and not extending into said internal flow passageway.

22. A blast nozzle comprising:

a. a body constructed of a non-conductive material, said body defining an internal flow passageway, said body having an entry end and an exit end, said internal flow passageway having an entry at said entry end and an exit at said exit end; and b. at least one electrically conductive path carried by said body and extending between proximal said entry end to proximal said exit end, said at least one electrically conductive path not extending into said internal flow passageway.

23. A method of blasting particles at a target, said method comprising the steps of:

a. providing a blast nozzle through which said particles flow, said nozzle including a body constructed of a non-conductive material, said body defining an internal passageway, said body having an entry end and an exit end, and a plurality of electrically conductive paths disposed along at least a portion of said body between said entry end and said exit end, said plurality of electrically conductive paths not extending into said internal flow passageway; and b. electrically grounding said plurality of electrically conductive paths.

* * * * *